United States Patent [19]

Goldstone

[11] Patent Number: 4,636,099

[45] Date of Patent: Jan. 13, 1987

[54] DOCUMENT HOLDER WITH PREPRINTED LOCATING AID

[76] Inventor: Ted A. Goldstone, 1423 E. Alameda Ave., Burbank, Calif. 91501

[21] Appl. No.: 726,788

[22] Filed: Apr. 24, 1985

Related U.S. Application Data

[63] Continuation-in-part of Ser. No. 428,945, Sep. 30, 1982, abandoned.

[51] Int. Cl.[4] ..... B41J 13/12

[52] U.S. Cl. ..... 400/531; 279/68 R; 400/622

[58] Field of Search ..... 400/531, 579, 522, 622, 400/619, 581, 511-512; 282/11.5 R, 11.5 A, 25; 40/124.2, 124.4, 158 B, 159; 229/68 R

[56] References Cited

U.S. PATENT DOCUMENTS

| | | | |
|---|---|---|---|
| 1,232,898 | 7/1917 | Dawson | 40/159 X |
| 1,410,130 | 3/1922 | Sinclair | 40/158 B |
| 1,522,543 | 1/1925 | Paine | 40/360 |
| 2,747,894 | 5/1956 | Porter | 40/124.4 |
| 2,775,050 | 12/1956 | Ellsworth | 40/159 |
| 2,842,882 | 7/1958 | Greene et al. | 40/158 B |
| 3,139,292 | 6/1964 | Swyden | 400/619 X |
| 3,191,968 | 6/1965 | Sornberger | 282/11.5 A |
| 3,214,083 | 10/1965 | Jory | 229/68 R |
| 3,324,823 | 6/1967 | Peters | 40/360 |
| 3,484,097 | 12/1969 | Jory | 270/52 |
| 3,658,163 | 4/1972 | Sniderman | 400/579 |
| 3,767,024 | 10/1973 | Banwarth | 400/619 |
| 3,804,226 | 4/1974 | Ellis | 400/531 |
| 3,837,565 | 9/1974 | Johnsen | 229/68 R |
| 3,967,776 | 7/1976 | Getsch et al. | 229/69 |
| 4,050,582 | 9/1977 | Kalve | 282/25 X |
| 4,222,187 | 9/1980 | Hulk | 40/124.4 X |
| 4,244,128 | 1/1981 | Russell | 40/158 A |
| 4,343,106 | 8/1982 | Ozeki | 40/158 B |
| 4,361,974 | 12/1982 | Wood | 40/158 B |

FOREIGN PATENT DOCUMENTS

| | | | |
|---|---|---|---|
| 8522 | 7/1927 | Australia | 400/124.2 |
| 2239156 | 2/1974 | Fed. Rep. of Germany | 282/11.5 A |
| 611767 | 11/1958 | Italy | 282/11.5 A |
| 602352 | 7/1978 | Switzerland | 400/622 |
| 198039 | 5/1923 | United Kingdom | 40/158 A |

OTHER PUBLICATIONS

"Continuous Form with Insert Pocket", IBM Technical Disclosure Bulletin, vol. 2, No. 2, Aug. 1959, p. 24.

*Primary Examiner*—E. H. Eickholt

*Attorney, Agent, or Firm*—Bogucki, Scherlacher, Mok & Roth

[57] ABSTRACT

A reusable document holder for use in a computer printer or electronic memory typewriter, including a strong, flexible plastic support material or sheet, preferably formed of the polyester Mylar, having a plurality of spaced document attachment areas for attachment thereon of documents, e.g. checks, to be printed in a computer printer, each of such areas having bands or straps at the corners, for insertion of such document beneath the bands, and a flap along the top edge for insertion of the top edge of such document beneath the flap. These elements support such documents and protect the top edges thereof when the document holder is fed through a printing device for printing on the documents or checks. Such bands and flap are formed by slitting or cutting the support material. Tractor feed holes are provided along the opposite edges of the support sheet for feeding the document holder through the device or printer, and line-up marks are provided on the plastic support to ensure correct loading and alignment of the document holder in the computer printer.

4 Claims, 3 Drawing Figures

DOCUMENT HOLDER WITH PREPRINTED LOCATING AID

CROSS-REFERENCE TO RELATED APPLICATION

This is a continuation-in-part of now abandoned application Ser. No. 428,945, filed Sept. 30, 1982, by Ted A. Goldstone for DOCUMENT HOLDER.

BACKGROUND OF THE INVENTION

The present invention relates to a document holder and more particularly to a document holder to be fed through a computer printer or electronic memory typewriter, for printing checks and other documents that are difficult to feed individually because of size, shape and other considerations.

It has heretofore generally been necessary to provide special continuous pre-printed documents corresponding to individual forms or records such as checks to enable a computer to imprint at the desired entry regions for data. Checks, postcards, envelopes and special document forms are examples of the type of output copy not suitable for efficient use with a computer printer because they require individual handling and positioning, whereas the printer is essentially designed for operation on continuous forms. Output printing on different types and sizes of documents, particularly those of small size, as well as printing close to document edges, especially along the bottom edges thereof, presents difficult if not insurmountable problems for computer printers. The preparation of special continuous forms requires preprinting of substantial quantities to be economically justified, and has the additional drawback of requiring the user to maintain two sets of documents for the same purpose. Thus special forms are not acceptable to a typical computer user who desires to print checks.

One object of the present invention is the provision of a document holder constructed to permit documents to be readily inserted into the holder and held in fixed position thereon while being fed through a computer printer or a high speed electronic memory typewriter, for rapid and automatic printing of entries on such documents.

Another object is the provision of a document holder of the type noted above, constructed of a flexible and durable material which can be readily fabricated, and which will receive and maintain documents in proper position when the holder is fed through any of a variety of printer makes and types.

A still further object is the provision of a document holder as above noted, containing means thereon for aligning the document holder in an initial position, for example in a computer printer, and means to readily permit movement of the document holder through the computer printer by means of the tractor device thereof.

SUMMARY OF THE INVENTION

According to the present invention there is provided a reusable document holder especially adapted for use in a computer printer or other device for printing or typing documents such as checks. The holder comprises a length of strong, flexible support material, particularly a plastic such as Mylar, having a plurality of attachment areas for positioning and holding a series of preselected documents in the respective attachment areas. The sheet of material has leading and trailing edge segments which permit easy entry into the printer and full printing on all documents, and is sufficiently firm to support pliant checks but thin enough to pass through the limited spaces in small and low cost printers. Means are provided in the attachment areas for securing documents in the respective areas on the support material without substantially increasing thickness or fragility. Indicia are disposed on the sheet for horizontal and vertical alignment of the sheet, and consequently the documents, relative to the printing lines of the device.

According to a preferred exemplification, the attachment areas of the flexible support material forming the holder each include diagonal bands or straps defined by slits at the corners of each attachment area, and with a top flap along the top edge of each of the attachment areas for overlapping the leading edge of a check. Such bands and flaps are formed by slitting the flexible support material by a die process, incorporating terminal curvatures which prevent tearing of the material and elongation of the slit. The document is inserted beneath the diagonal straps, with the top edge beneath the flap in each of the attachment areas, and to avoid catching and peeling up of the leading edge of the document when fed through a computer printer. The position of insertion of the document is instantly recognized by the user because a facsimile of the inserted document is imprinted on the holder itself.

When checks, for example, have been mounted at the attachment areas of the holder it may be fed into a printer or electronic memory typewriter as though it were normal paper, such as single sheet, rolled or fanfold. Tractor feed holes are provided along opposite edges of the flexible support material forming the holder, to be engaged by the tractor device of a computer printer. The tractor feed holes are oversize relative to the pins in order to allow usage with a variety of printers and avoid binding problems due to tolerance variations. The pins engage the top of the sprocket holes in advancing the holder through in the forward direction. However, the holder may be advanced without a tractor feed by a friction drive. The horizontal and vertical line-up marks on the document holder ensure correct loading and alignment in both the vertical and horizontal planes, for printing under computer command. The sheet can be reloaded and used for printing many times, and can be used on a number of different printers.

BRIEF DESCRIPTION OF THE DRAWINGS

The invention will be more clearly understood by reference to the following description, taken in connection with the accompanying drawings wherein.

DETAILED DESCRIPTION OF THE INVENTION

Figure 1:
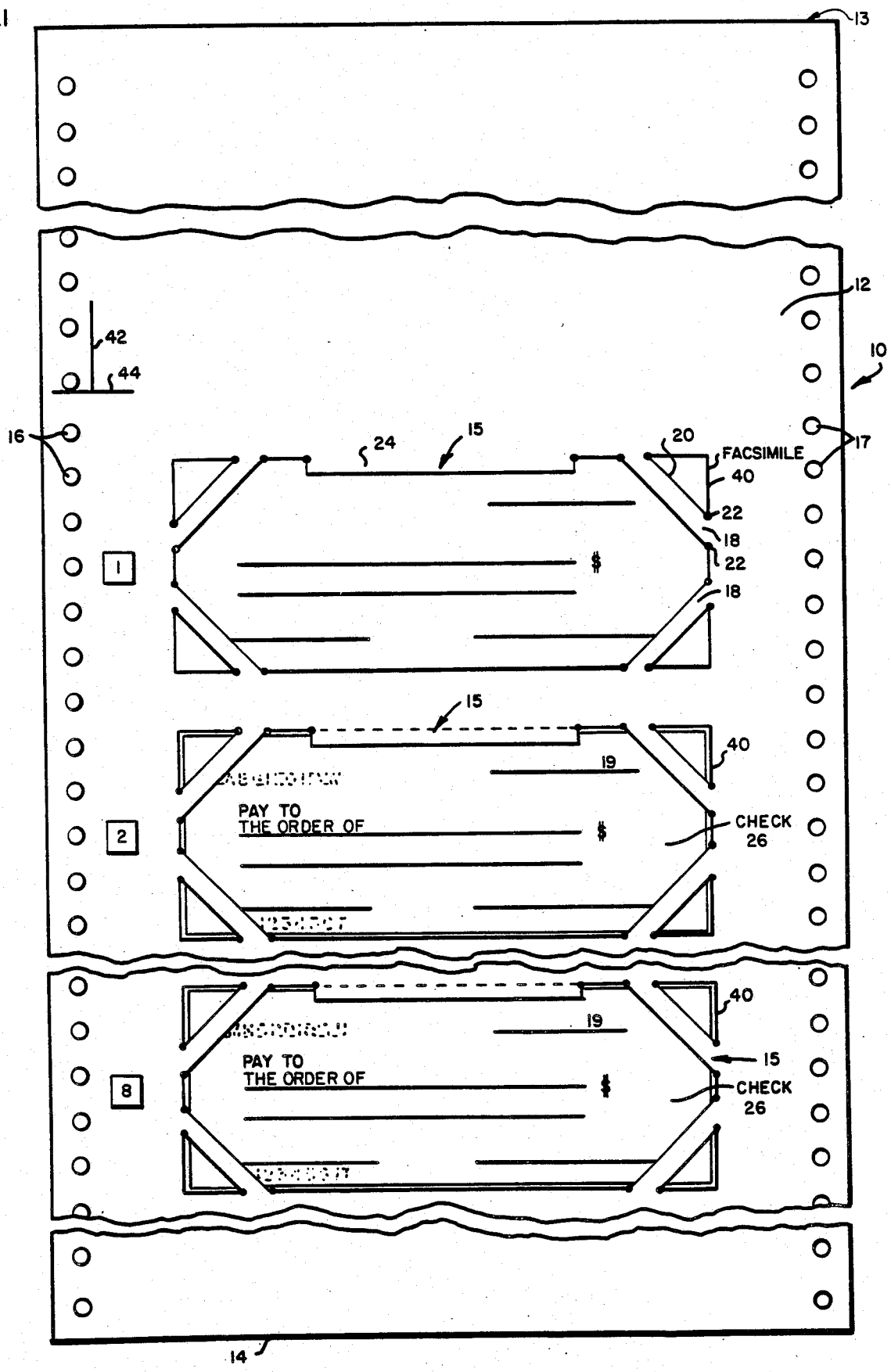
FIG. 1 is a plan view of a specific example of the document holder of the invention, showing a plurality of attachment areas for receiving and maintaining a series of checks in position to be fed through a computer printer.

As illustrated in FIG. 1 of the drawing, numeral 10 designates a document holder according to the invention, for use in imprinting ordinary band checks with a computer printer in this instance. The holder 10 comprises a finite length of a support member or sheet 12 in the form of a strong, flexible, and durable material such as a suitable plastic, for example, a polyester plastic, particularly the material marketed as "Mylar". The document holder sheet 12 is preferably formed of a length of material adequate for a number of checks, here eight, with a leading edge 13 of approximately 9" and a trailing edge 14 of about 4". The checks are insertable in different ones of a series of vertically spaced and vertically aligned essentially rectangular attachment areas 15. These areas 15 extend from a first location after the leading edge 13 to the inside border of the trailing edge 14 of the sheet 12. The leading and trailing edges 13, 14 in series with the attachment areas 15 enable the sheet 12 to be entered into a printer, pulled through, and positioned accurately. The sheet 12 feeds all checks past a print line in precise relation, with the last check being printable through its entire area without loss of control. The sheet 12 is of a reasonable length to load with the specified number of checks (or less), and also to be stored conveniently and to be handled without tangling or folding. Moreover, precisely shaped sheets 12 including attachment areas 15, and sprocket holes 16, 17 can be fabricated by die cutting in a one step, low cost operation. Along adjacent sides of flexible sheet 12 of the holder are vertically spaced sprocket holes 16 and 17 which receive drive pins of the tractor mechanism of a computer printer (see FIG. 3) for moving the document holder through the printer. The sprocket holes 16, 17 extend along the entire edge because of the design of some computer printers, which would otherwise bind.

The tractor sprocket holes 16 and 17 are usually precisely fashioned in most sheets and papers so that they are the same size as the tractor pins. However, in the present device, such sprocket holes are made larger than the tractor pins. Such "oversizing effect" holds the position of the sheet 12 without its being misaligned when passing through the computer printer, thus avoiding the need for high manufacturing tolerances for the sprocket holes. In practice, the tractor pins engage the leading edges of the holes 16, 17 so that oversizing does not create excessive play in sheet 12 movement. The size relationship enables the sheet 12 to be used with a number of different computer types.

The base member or sheet 12 of the document holder 10 is fabricated of a highly durable material which is flexible, yet still has sufficiently rigidity and stiffness to be self supporting and less pliant than the checks it is to support. The material limits any significant wear which might alter the position of the attachment areas 15, or the sprocket holes 16 and 17. It helps also to insure the accuracy of printing of documents placed on the attachment areas 15, in the manner noted below, each and every time the document holder is used. The flexible polyester sheet material "Mylar" has been found particularly effective in this respect. However, other strong flexible materials such as vinyl plastics and cellophane can be employed. Mylar used in the thicknesses specified below also has a cushioning effect on an impacting printer mechanism when it passes through a computer printer or electronic memory typewriter.

The flexible support or sheet material 12, preferably of Mylar, should be at least 0.003 inch (3 mils) thick to provide sufficient rigidity and body to facilitate the loading of the flimsier checks or other documents into the attachment areas 15 of the holder. Also, these attributes facilitate loading the document holder into the computer printer or electronic memory typewriter. It has been found by testing that thicknesses of the sheet 12 can range from 0.003 inch (3 mils) to about 0.007 inch (7 mils) for general application. Greater thicknesses such as 0.007 inch do not provide as much flexibility and do not pass through the paper guide system of the average printer.

Each of the attachment areas 15 comprises four diagonally positioned holding straps or bands 18 each formed by paired parallel slits 20 in the flexible sheet material 12. The opposite ends of each slit 20 terminate in small circular or arcuate cuts 22 which provide tear limiting termini to prevent sharp stress increases. A flap 24 along the top edge covering a portion of the check area is also formed by cutting or slitting the sheet material 12.

Figure 2:
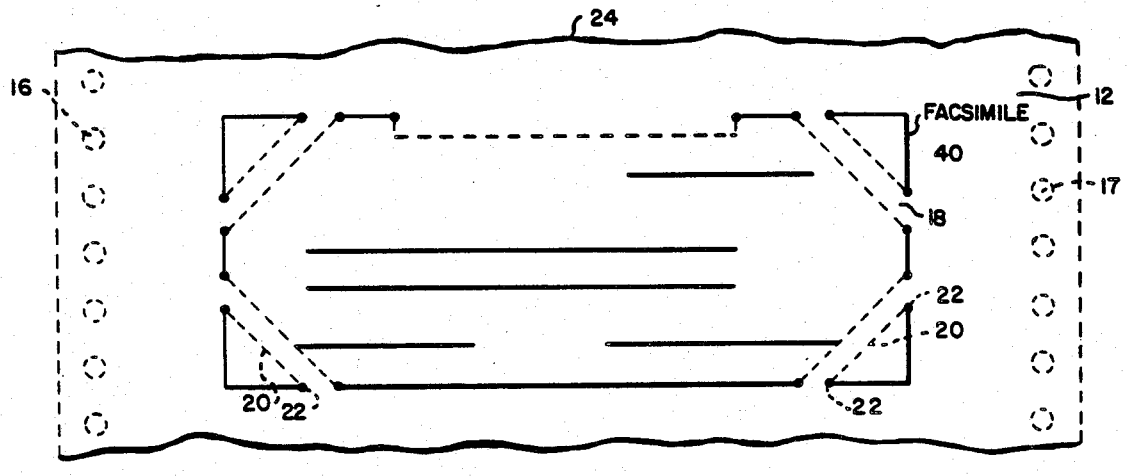
FIG. 2 illustrates one phase in a sequence for providing the attachment areas in the document holder of FIG. 1.

FIG. 2 shows a step in a procedure for providing the straps or bands 18, the flap 24, the sprocket holes 16, 17 and the side edges of the sheet. Using a formed die and a reciprocal drive, slits 20 and end circles 22 are formed along diagonally positioned parallel dashed lines into each corner of the attachment areas 15 at the same time that side cuts are made and sprocket holes 16, 17 are punched. All of these cuts are shown in dotted lines in FIG. 3. Concurrently a slit is made along the dashed line at the top of the attachment area 15 to create the flap 24 in the sheet 12. The die may cut multiple thicknesses of sheet 12 simultaneously, and be wide enough to create adjacent stacks of sheets 12 simultaneously. Using a limited number of checks, such as the eight shown in FIG. 1, enables both die cutting and individual handling by the user to be most efficient, and cost effective.

Referring again to FIG. 1, this construction permits a document such as a check 26 to be inserted in each of the attachment areas 15 for printing, with the corners of the check 26 under the different diagonal holding straps 18, and the leading edge of the check 26 under the top edge flap 24. These overlying members maintain the checks in secure position in the attachment areas 15 during advance through the printer. The top flap 24 avoids snagging and "peeling up" of the check during its travel through the computer printer or electronic memory typewriter. The relatively flimsy check can readily jam the machine if its leading edge becomes caught on an inner surface. This has been found to be the most secure design for holding a document in the attachment areas according to the invention.

The attachment areas 15 are also visually defined by printed matter providing a generalized facsimile of the check as indicated at 40, in those areas other than the bands 18 and flap 24, in order that the user can see an instinctively understood graphical depiction of how the check 26 is to be inserted at the attachment area 15. In this respect it has been found that Mylar is additionally advantageous for use as the holder sheet 12, because the facsimile 40 in the attachment area 15 does not smear on this substrate. Instead of a facsimile, other demarcations can be used at the attachment areas 15, such as stripping or an outline of the check or other document, together with instructions as to how to insert the document, if desired.

Other printing on the sheet 12 includes a horizontal line-up mark 42 orthogonal to a vertical line-up mark 44 between the leading edge portion and the first check 26. These marks enable the user to center the sheet 12 and the checks 26 relative to the printer. A vertically positioned line-up mark 44 is provided to set the sheet 12 so that print lines are properly positioned on the checks. Thus, the line-up marks 42, 44 ensure correct loading and alignment for printing in both the vertical and horizontal planes. The system software can then advance the first line on the first check to printing position, sequence through the printing positions for the check, and then advance to the next check, and so on. Index marks (not shown) can be provided for optical sensing on the document holder to allow automatic control of the feed of the document holder 10 through the computer printer or electronic typewriter if desired. However, the manual positioning approach is more realistic from the standpoint of cost, versatility and interchangeability with a number of printers.

Figure 3:
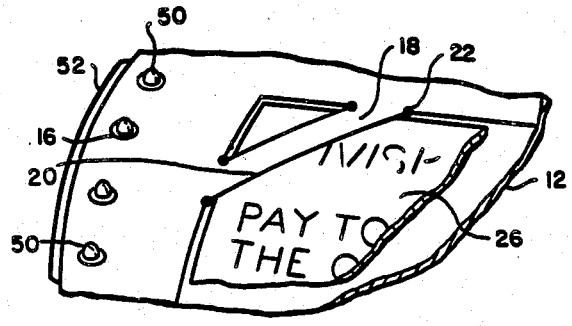
FIG. 3 is an enlarged fragmentary perspective view of a portion of a document holder in operative position on a printer.

FIG. 3 shows how the oversize sprocket holes (e.g. holes 16) on the sheet 12 supporting a check 26 receive the tractor pins 50 on a drive roller 52 (only the edge of which is indicated). Because the holes 16 easily encompass the drive pins 50, the engagement is at the leading edges of the holes and precise position is maintained as the sheet 12 passes through.

Any printable item or document, including, but not limited to, notes, postcards, checks, letterheads, envelopes, forms, labels, and the like, can be held in the document holder of the invention, to be fed through and printed on by any computer printer or electronic memory typewriter. The sizes of the documents or items to be held by the document holder can be varied on the same holder as by varying the size of the attachment areas. Further, more than one set of attachment areas can be provided on the same document holder by overlaying smaller items or documents such as checks with larger items or documents such as envelopes. In addition to permitting printing on all types and sizes of documents or items, particularly items of small size, the document holder of the invention permits printing thereon very close to the document edges, especially along the bottom edge, which is normally very difficult. Also the presence of the trailing edge length after the last check insures that the "end of paper" detector used with many printers will not be triggered to shut off the machine prematurely. Further, some printers push rather than pull the paper through the machine, and the trailing edge portion facilitates this action as well. Alternatively or in addition, indicia or instructions may be incorporated, as along the leading edge portion, to instruct as to the manner of insertion and use.

From the foregoing, it is seen that the invention provides a highly useful, yet simple and durable reusable document holder, which is particularly designed for printing or typing documents on a computer printer or an electronic memory typewriter, providing multiple attachment areas for the documents, to hold and align the documents during feeding through any of a number of somewhat different computer printers or electronic memory typewriters. The sheet is an integral member arranged to pass printable documents, particularly checks, smoothly through different printers, to be strong and firm enough to protect the fragile checks but thin enough to prevent catching or binding in the machine, while avoiding wrinkling, tearing and other damage. The attachment structure provides protection at least along the top edge of the document through the provision of a flap type arrangement. All of these features are achieved in a single step by die cutting a given length (two or more layers and a number of parallel sheets may be formed simultaneously) limited by cutting machine size. However, this length is also largely consistent with the length of sheet that can conveniently be handled. It will be recognized that the specific dimensions of document holder best suited for a particular application can be optimized somewhat, within the ranges specified, for the particular printer that is used and the characteristics of the type of document to be imprinted.

Accordingly, while various alternatives, modifications, and variations of the invention will be further apparent to those skilled in the art, the invention is not to be taken as limited except by the scope of the appended claims.

What is claimed is:

1. A reusable document holder for printing on inserted checks and like pliant documents especially adapted for use in a computer printer of friction or pin drive type which feeds the checks through in a given feed direction, which comprises:

(a) a strong, flexible polyester support film having a thickness ranging from about 0.003 inch (3 mils) to about 0.007 inch (7 mils);

(b) a plurality of vertically spaced attachment areas of predetermined shape on said support film for attachment of different checks of similar shape but that may vary in thickness and rigidity in said respective areas, the spacing of the attachment areas defining successive printing positions;

(c) means provided in said attachment areas for attaching and supporting the checks in said respective areas on said support film, said attaching and supporting means comprising a plurality of essentially diagonally disposed straps, at least one at each of the corners of said attachment areas, said straps formed by cutting said support material for insertion of said check beneath said straps in the respective attachment areas;

(d) a flap provided along the leading edge of each of said attachment areas, said flap formed by slitting said support material, for insertion of the top edge of said check beneath the flap in each of said attachment areas said support film including printed matter thereon corresponding to the pattern of a check in areas other than said straps and said flap, to aid in locating said straps and said flap for insertion of a check in proper position;

(e) aligned tractor feed holes along opposite edges of said plastic support film for receiving the pins of a tractor feed mechanism on said computer printer, for loading and alignment of said support film in said computer printer, and feeding said document holder in the feed direction; and (f) line-up marks on said document holder prior to the leading attachment area to ensure proper initial loading and alignment of said support film in the computer printer, such that printed entries will properly be positioned on the subsequently printed checks.

2. A device for enabling checks to be printed under computer control on any of a number of printer types having sprocket pin drives comprising:

a thin, reusable sheet having spaces for receiving a number of checks in spaced apart relation along its length, the sheet including a leading edge portion before the first check for feeding into a printer and a trailing edge portion after the last check thereon, the sheet further having adequate structural firmness to support checks moving through the printer mechanism and comprising:

means defining regularly spaced sprocket holes adjacent the side margins thereof for receiving printer sprockets, said holes being oversize relative to the sprocket pins;

means imprinted along the sheet at spaced apart regions defining facsimiles of the checks at successive printing areas;

means at the printing areas for defining check retention means in the form of diagonal straps across the different corners of the checks, said retention means comprising means defining slits in the sheet, the slits terminating at curved end apertures; and visible means imprinted on the check holder for defining reference indicia for lengthwise and transverse positioning of the holder in the printer such that checks positioned in the successive printing areas can be printed upon at selected data entry regions as the sheet is advanced.

3. The invention as set forth in claim 2 above, wherein the sheet is a die cut plastic sheet having die cut slits and sprocket holes as well as outline, and wherein the means defining curved end apertures define circular end stops for each end of the slits.

4. The invention as set forth in claim 3 above, wherein the sheet has a leading edge portion greater than 6" in length and a trailing edge portion greater than 3" in length and is of polyester material of between 0.003" and 0.007" in thickness.

* * * * *